US007201608B2

(12) United States Patent
Rosenberger et al.

(10) Patent No.: US 7,201,608 B2
(45) Date of Patent: Apr. 10, 2007

(54) CO-AXIAL PLUG FOR A CO-AXIAL PLUG AND SOCKET CONNECTOR

(75) Inventors: Bernd Rosenberger, Tittmoning (DE); Christian Entsfellner, Fridolfing (DE); Andreas Fellner, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 10/555,647

(22) PCT Filed: May 12, 2005

(86) PCT No.: PCT/EP2005/005173

§ 371 (c)(1),
(2), (4) Date: Oct. 6, 2006

(87) PCT Pub. No.: WO2005/114795

PCT Pub. Date: Dec. 1, 2005

(65) Prior Publication Data

US 2007/0042640 A1 Feb. 22, 2007

(30) Foreign Application Priority Data

May 12, 2005 (DE) ..... 20 2004 227 909 U

(51) Int. Cl.
*H01R 9/05* (2006.01)

(52) U.S. Cl. ..... 439/578; 439/352

(58) Field of Classification Search ..... 439/350–358, 439/345, 348, 578–585
See application file for complete search history.

(56) References Cited

U.S. PATENT DOCUMENTS

| | | | | |
|---|---|---|---|---|
| 3,680,033 | A * | 7/1972 | Kawai | 439/352 |
| 5,173,533 | A | 12/1992 | Yabuta et al. | |
| 5,176,533 | A * | 1/1993 | Sakurai et al. | 439/352 |
| 5,595,499 | A * | 1/1997 | Zander et al. | 439/352 |
| 5,690,503 | A * | 11/1997 | Konda et al. | 439/348 |
| 5,746,619 | A * | 5/1998 | Harting et al. | 439/352 |
| 6,132,234 | A * | 10/2000 | Waidner et al. | 439/358 |

FOREIGN PATENT DOCUMENTS

| | | |
|---|---|---|
| DE | 195 1180 | 5/1970 |
| EP | 1 331 701 A1 | 7/2003 |

* cited by examiner

*Primary Examiner*—Truc T. Nguyen
*Assistant Examiner*—Edwin A. Leon
(74) *Attorney, Agent, or Firm*—Lowe, Hauptman & Berner LLP

(57) ABSTRACT

A co-axial plug has a cylindrical outer-conductor part having mating co-axial cable ends. A latching sleeve fits around and is axially displaceable relative to the shell outer-conductor. Opposite ends of a spring are supported against the shell outer-conductor part and the latching sleeve to pre-load the latching sleeve toward the co-axial cable end of the shell outer-conductor part. Axial slots at the latching sleeve mating end form elastically resilient latching tongues having, at their ends, a latching edge extending in a radially outward direction. An unlocking sleeve surrounding the latching sleeve is displaceable axially relative to the latching sleeve having a ramp extending outwardly and sloping toward the cable end. The ramp co-operates with a correspondingly bevelled groove on the unlocking sleeve inside face so displacement of the unlocking sleeve relative to the latching sleeve toward the co-axial cable end bends the latching tongues inwardly.

15 Claims, 3 Drawing Sheets

CO-AXIAL PLUG FOR A CO-AXIAL PLUG AND SOCKET CONNECTOR

RELATED APPLICATIONS

The present application is based on, and claims priority from, International Application No. PCT/EP2005/005173 filed Nov. 4, 2005 and German Application No. 202004007909.7 filed May 17, 2004, the disclosures of which are hereby incorporated by reference herein in their entirety.

FIELD OF THE INVENTION

The present invention relates to a co-axial plug for a co-axial plug and socket connector. The invention also relates to a co-axial plug and socket connector having a co-axial plug and a bulkhead socket.

BACKGROUND ART

Co-axial plug and socket connectors comprising a co-axial plug and a co-axial bulkhead socket which, when plugged together and connected to one another, produce co-axial plug-in contact. To allow a plug and socket to be connected in the case of co-axial plug and socket connectors of the so-called N type, the socket has a thread on its outer circumference. The plug is fitted with a union nut which likewise has a thread, on its inner circumference. An N plug and an N socket are connected by being plugged together and the union nut of the N plug is screwed, by its inside thread, onto the outside thread on the N socket. The connection of co-axial plug and socket connectors of the N type in this way has long been known and provides a good and secure HF contact between the plug and socket. However, it is often felt to be a disadvantage of this arrangement that the screwing operation takes a relatively large amount of manual effort and a relatively long time to connect the plug and socket. In applications where, for example, a large number of co-axial connections are to be made between plugs and sockets, the manual effort and time spent adds up to a considerable total.

An object of the invention is to provide a new and improved co-axial plug particularly designed to facilitate connecting and disconnecting operations.

Another object is to provide a new and improved co-axial plug that is highly reliable.

SUMMARY OF THE INVENTION

In accordance with an aspect of the invention, a co-axial plug includes a latching sleeve which fits around an outer-conductor part of a shell and which is axially displaceable relative to the outer-conductor part of the shell. First and second ends of a spring are respectively supported against the outer-conductor part of the shell and against the latching sleeve, in such a way that the latching sleeve is pre-loaded toward the co-axial cable end of the outer-conductor part of the shell. The latching sleeve has axial slots at its mating end so that elastically resilient latching tongues are formed. The latching tongues each have, at their mating ends, a latching edge which extends upwards in a radially outward direction. An unlocking sleeve surrounds the latching sleeve and is displaceable axially relative to the latching sleeve. The latching sleeve has a ramp which extends upwards in a radially outward direction and which slopes up in the direction of the co-axial cable end. The ramp co-operates with a correspondingly bevelled groove in an inside face of the unlocking sleeve in such a way that displacement of the unlocking sleeve relative to the latching sleeve in the direction of the co-axial cable end causes the latching tongues of the latching sleeve to bend inwards radially.

The construction has the advantage that a bulkhead socket which has, in an inside wall of its shell, adjacent the mating end, a round annular groove that forms a latching edge that can easily be fastened to and released again from the co-axial plug as and when desired. A co-axial plug and socket connector which employs this co-axial plug can be connected and disconnected again easily, quickly and with an assurance of reliable operation without screwed connections having to be operated.

In a preferred embodiment, a stop for the latching sleeve is at the co-axial cable end of the outer-conductor part of the shell. The stop sets a limit for axial movement of the latching sleeve toward the co-axial cable end of the outer-conductor part of the shell.

In a co-axial plug and socket connector of the above kind, provision is made in accordance with the invention for the co-axial plug to be as described above. This has the advantage that the co-axial plug-in connection can be connected and disconnected again easily, quickly and with an assurance of reliable operation without screwed connections having to be operated.

In a preferred embodiment, a mating end of the groove, which mating end forms the latching edge, is spaced 2.8 mm to 3 mm, and in particular 2.9 mm, away from the mating end of the bulkhead socket.

The shell usefully has on its outer circumference a thread to engage with an inside thread in a union nut belonging to a conventional co-axial plug. In this way, the bulkhead socket can, if desired, also be connected to a standard, conventional co-axial plug which has screwed fastening means.

BRIEF DESCRIPTION OF THE DRAWINGS

A preferred embodiment of the invention is described in detail below by reference to the drawings. In the drawings.

DETAILED DESCRIPTION OF THE DRAWINGS

Figure 1:
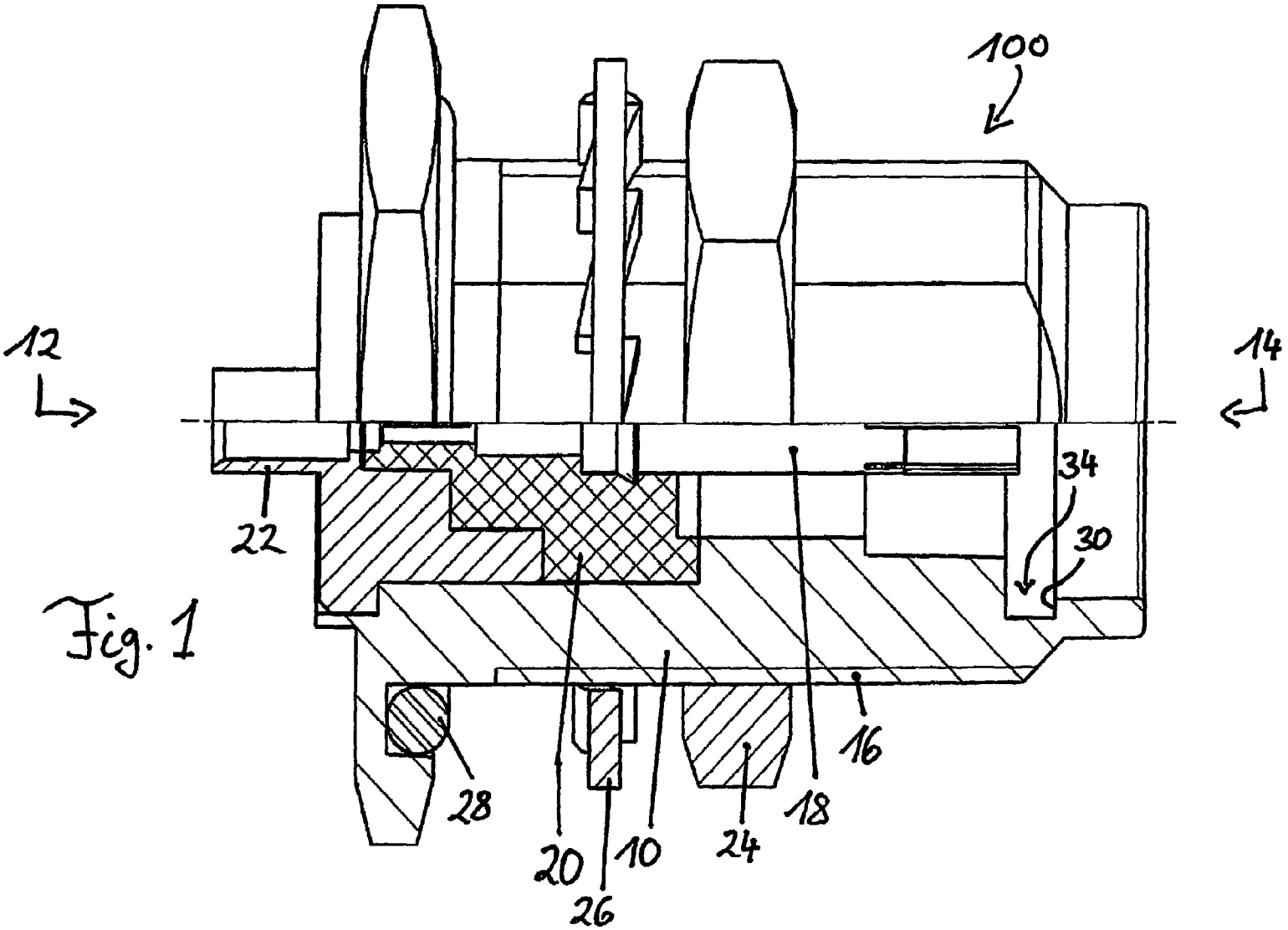
FIG. 1 is a side view, partly in section, of a preferred embodiment of bulkhead socket according to the invention.

FIG. 1 includes a drawing of a bulkhead socket 100 of the N type for a co-axial plug and socket connector, having a cylindrical shell 10 which forms an outer conductor and which has a co-axial cable end 12, a mating end 14, and, on its outer circumference, an outside thread 16. The bulkhead socket 100 also comprises a centre conductor 18, an insulating part 20, a female solder connection 22, a hexagon nut 24, a lock washer 26 and an O-ring 28.

This N-type bulkhead socket 100 is of a standardised design, except as follows: at the mating end 14, a latching edge 30 is formed in the inner circumference of the shell 10, by providing a round annular groove 34 or in an inside face of the shell 10. The groove 34 is formed by stock-removing machining the standardised inner circumference of the shell 10, at the mating end 14. This configuration of the inner circumference of the shell 10 at the mating end 14, which is non-standard, is of a form such that operation is not adversely affected in any way when a conventional co-axial plug having a union nut is plugged in, which means that even a standard N-type co-axial plug having an internally threaded union nut can be fastened to a bulkhead socket as shown in FIG. 1.

Because of the design of the bulkhead socket 100, it is also possible to plug in a specially designed co-axial plug of a quick-action fastening type. This special co-axial plug has a latching element which engages behind the latching edge 30 and, in co-operation with the latching-edge 30, makes a mechanically firm connection between the bulkhead socket and the co-axial plug.

Figure 2:
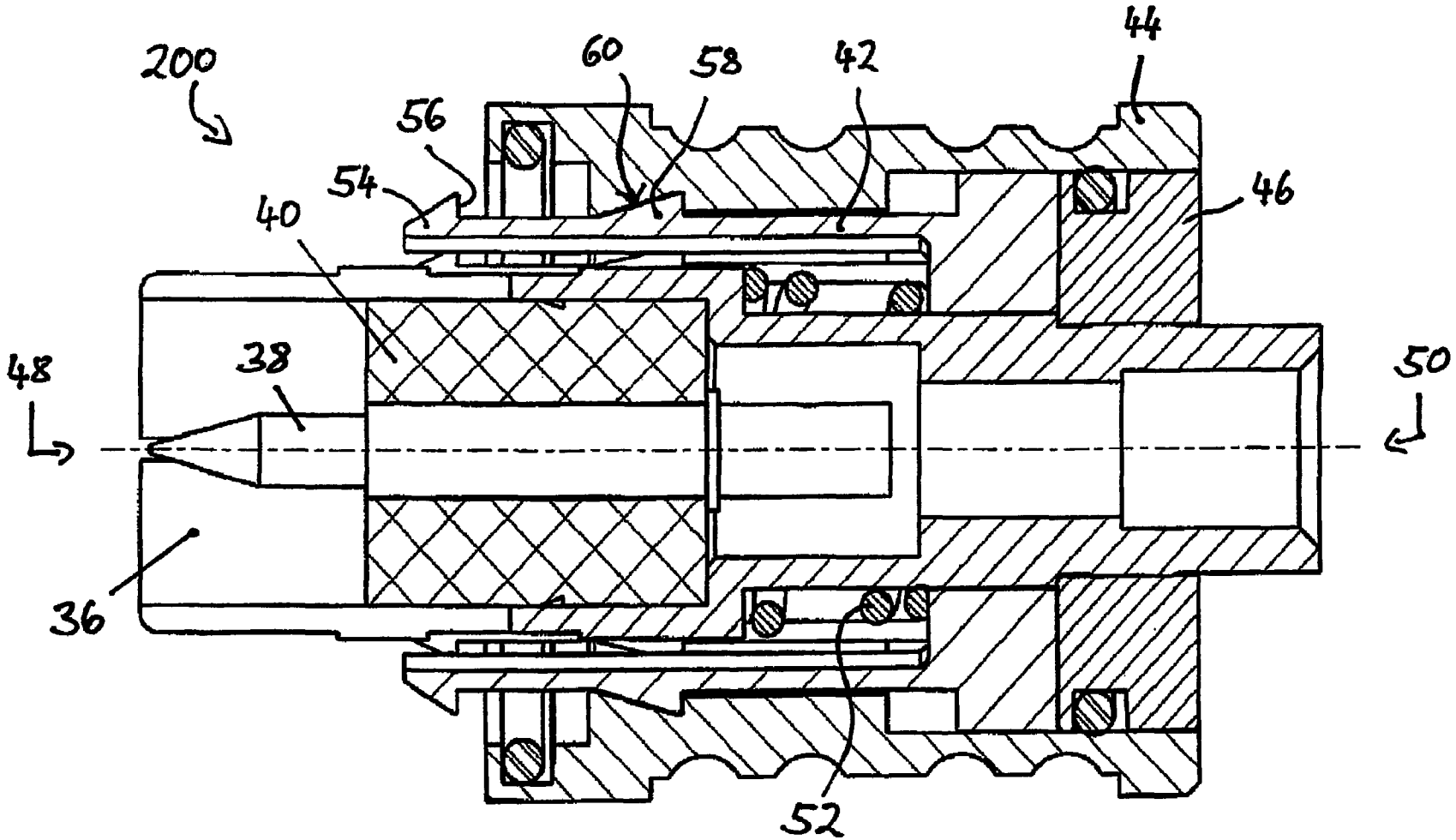
FIG. 2 is a view in section of a co-axial plug which fits with the bulkhead socket shown in FIG. 1.

A specially designed co-axial plug 200 of this kind is shown in FIG. 2 and comprises a cylindrical outer-conductor part 36 of the shell which forms an outer conductor, a centre conductor 38, an insulating part 40, a latching sleeve 42, an unlocking sleeve 44 and a compression ring 46. The outer-conductor part 36 of the shell has a mating end 48 and a co-axial cable end 50. The latching sleeve 42 fits around the outer-conductor part 36 of the shell. A spring 52 is provided which is supported by one of its ends against the outer-conductor part 36 of the shell and by other end against the latching sleeve 42, in such a way that latching sleeve 42 is pre-loaded toward co-axial cable end 50 of the outer-conductor part 36 of the shell. At the co-axial cable end 50 of the outer-conductor part 36 of the shell, there is formed a stop for the latching sleeve 42 in the form of the compression ring 46, which sets a limit for axial movement of the latching sleeve 42 in the direction of the co-axial cable end 50 of the outer-conductor part 36 of the shell. At its mating end 48, the latching sleeve 42 is formed to have axial slots, thus producing elastically resilient latching tongues 54. At their mating ends, each of latching tongues 54 has a latching edge 56 which extends upwards in a radial outward direction. The unlocking sleeve 44 surrounds the latching sleeve 42 and is axially displaceable relative to the latching sleeve 42. The latching sleeve 42 has a ramp 58 which extends upwards in a radial outward direction and slopes up toward the co-axial cable end 50, which ramp 58 co-operates with a correspondingly bevelled groove 60 in an inside face of the unlocking sleeve 44 in such a way that displacement of the unlocking sleeve 44 relative to the latching sleeve 42 toward the co-axial cable end 50 causes the latching tongues 54 of the latching sleeve 42 to be bent radially inwards.

Figure 3:
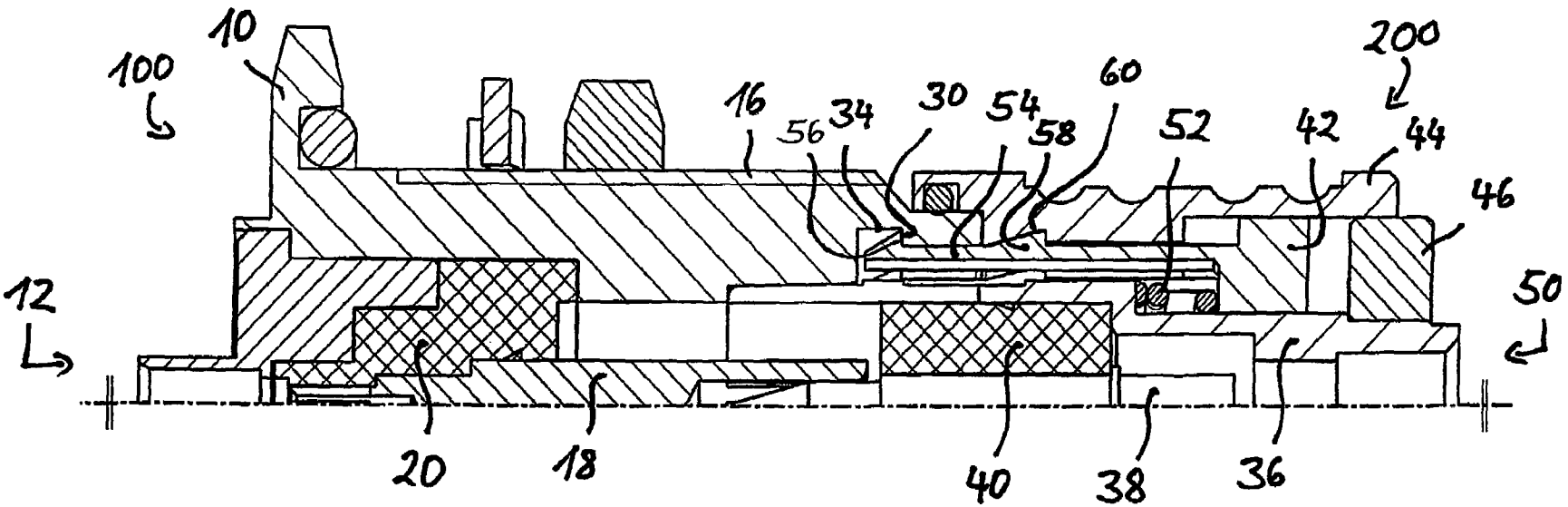
FIG. 3 is a view in section of the bulkhead socket of FIG. 1 and the co-axial plug of FIG. 2, in the plugged-together state.

FIG. 3 is an illustration of how the locking mechanism between the bulkhead socket 100 and the co-axial plug 200 operates. In the plugged-in state, the latching tongue 54 having the latching edge 56 engages behind the latching edge 30 of the groove 34. This produces a locking retention between the bulkhead socket 100 and the co-axial plug 200 without a screwed connection being made for this purpose. Instead, the co-axial plug 200 merely has to be pushed into the bulkhead socket 100. Because the latching edge 56 has a ramp-like configuration, edge 56 automatically slides past the latching edge 30, the latching tongues 44 being bent radially inwards elastically, and into groove 34. The unlocking sleeve 44 is used to release this latched mechanical connection again. For this purpose, the latching sleeve 44 is displaced axially, relative to the latching sleeve 42, in other words relative to the outer-conductor part 36 of the shell, toward co-axial cable end 50 of the co-axial plug 200. Because of this, bevelled groove 60 slides over ramp 58 on latching sleeve 42, whereby latching tongues 54 are bent radially inwards. This causes the latching edge 56 to be freed from its engagement with the latching edge or nose 30, thus enabling the co-axial plug 200 to be withdrawn from the bulkhead socket 100.

The invention claimed is:

1. A co-axial plug adapted to fit a socket connector, comprising a cylindrical outer-conductor part including a shell which forms an outer conductor having a mating end and a co-axial cable end, a latching sleeve fitting around the outer-conductor part of the shell, the latching sleeve being axially displaceable relative to the outer-conductor part of the shell, a spring supported at (a) a first of its ends against the outer-conductor part of the shell and (b) at a second of its ends against the latching sleeve, in such a way that the latching sleeve is pre-loaded in the direction of the co-axial cable end of the outer-conductor part of the shell, the latching sleeve having axial slots at its mating end to form elastically resilient latching tongues, each of said latching tongues having, at mating ends thereof a latching edge which extends upwards in a radially outward direction, surrounding the latching sleeve, the unlocking sleeve being axially displaceable relative to the latching sleeve, the latching sleeve having a ramp which extends upwards in a radially outward direction and which slopes up in the direction of the co-axial cable end, the ramp being arranged to co-operate with a correspondingly bevelled groove in an inside face of the unlocking sleeve in such a way that displacement of the unlocking sleeve relative to the latching sleeve in the direction of the co-axial cable end causes the latching tongues of the latching sleeve to bend inwards radially.

2. The co-axial plug of claim 1 wherein the plug is adapted to fit an N-type socket connector.

3. The co-axial plug according to claim 1, wherein the co-axial cable end of the outer-conductor part of the shell includes a stop for the latching sleeve, the stop being arranged to set a limit for axial movement of the latching sleeve in the direction of the co-axial cable end of the outer-conductor part of the shell.

4. The co-axial plug of claim 3 in combination with a bulkhead socket connector.

5. The combination of claim 4, wherein the bulkhead socket has a cylindrical shell which forms an outer conductor and has a co-axial cable end and a mating end, a round groove having an annular shape on an inside wall of the shell adjacent the mating end, the groove forming a latching edge.

6. The combination of claim 5, wherein the shell has on its outer circumference a thread for engaging an inside thread in a union nut of a conventional co-axial plug.

7. The combination of claim 5, wherein the groove has a mating end which forms the latching edge, the mating end of the groove being spaced 2.8 mm to 3 mm from the mating end of the bulkhead socket.

8. The combination of claim 7, wherein the spacing is 2.9 mm.

9. The combination of claim 7, wherein the shell has on its outer circumference a thread for engaging an inside thread in a union nut of a conventional co-axial plug.

10. The co-axial plug of claim 1 in combination with a bulkhead socket connector.

11. The combination of claim 10, wherein the bulkhead socket has a cylindrical shell which forms an outer conductor and has a co-axial cable end and a mating end, a round groove having an annular shape on an inside wall of the shell adjacent the mating end, the groove forming a latching edge.

12. The combination of claim 11, wherein the shell has on its outer circumference a thread for engaging an inside thread in a union nut of a conventional co-axial plug.

13. The combination of claim 11, wherein the groove has a mating end which forms the latching edge, the mating end of the groove being spaced 2.8 mm to 3 mm from the mating end of the bulkhead socket.

14. The combination of claim 13, wherein the spacing is 2.9 mm.

15. The combination of claim 13, wherein the shell has on its outer circumference a thread for engaging an inside thread in a union nut of a conventional co-axial plug.

* * * * *